US006939152B1

(12) United States Patent
Chen

(10) Patent No.: US 6,939,152 B1
(45) Date of Patent: Sep. 6, 2005

(54) MICROSWITCH CONNECTOR

(76) Inventor: Su-Lien Chen, 8F, No. 5-1, Lane 89, Liancheng Rd., Zhonghe City, Taipei County 235 (TW)

( * ) Notice: Subject to any disclaimer, the term of this patent is extended or adjusted under 35 U.S.C. 154(b) by 64 days.

(21) Appl. No.: 10/896,225

(22) Filed: Jul. 20, 2004

(51) Int. Cl.[7] ..... H01R 29/00
(52) U.S. Cl. ..... 439/188
(58) Field of Search ..... 439/188, 513, 439/944; 200/51.1

(56) References Cited

U.S. PATENT DOCUMENTS 6,099,334 A * 8/2000 Togashi ..... 439/188
6,520,785 B2 * 2/2003 Hida ..... 439/188
6,666,699 B2 * 12/2003 Uratani ..... 439/188
6,751,317 B2 * 6/2004 Shima et al. ..... 379/438
6,808,405 B1 * 10/2004 Uratani et al. ..... 439/188

* cited by examiner

*Primary Examiner*—Briggitte R. Hammond
(74) *Attorney, Agent, or Firm*—Charles E. Baxley

(57) ABSTRACT

A microswitch connector comprises a support, an "A" leg, a spring plate, a casing and a base. The "A" leg and a stepped foot of the spring plate are received in a stepped hole on the support. V-shaped foldable elements of the "A" leg and the spring plate correspond to receiving gaps of the base. An abutting piece is provided inside receiving gaps of the base. Plural positioning cavities corresponding to the support legs on the casing are formed on the base. A projecting conductive pointing is formed at the end of the "A" leg. Through the above structures, the respective elements of the microswitch are firmly positioned.

10 Claims, 7 Drawing Sheets

MICROSWITCH CONNECTOR

BACKGROUND OF THE INVENTION

1. Field of the Invention

This invention relates to a microswitch connector, and more particularly to a mircroswitch connector, which is compact in structure and capable of preventing damages caused by testing device during production test.

2. Description of the Prior Arts

A traditional microswitch connector is shown in FIG. 1, which generally includes a support, an "A" leg 11, a spring plate, a casing 13 and a base 14 superimposed on one another. The support 10 is formed with plural through holes 15 for the reception of "L"-shaped foot of the "A" leg 11 and that of the spring plate 12, and both the "A" leg 11 and the spring plate 12 are provided with a "I"-shaped plug-in element 17 corresponding to gaps 18 on the base 14. The casing 13 employs four legs 19 to directly engage with the outer periphery of the base 14. The traditional microswitch connector has been used for a long time, however, it still has some problems left unsolved:

First, since the support 10 only uses the through holes 15 to receive the L-shaped foot 16 of the "A" leg 11 and that of the spring plate 12, the L-shaped foot 16 and the spring plate 12 are unlikely to be positioned on the support 10 firmly.

Second, the four legs 19 of the casing 13 are directly engaged with the outer periphery of the base 14 and protruded out of bottom surface of the base 14, however, the legs 19 are unfixed and likely to move relative to the base 14.

Third, the I-shaped plug-in elements 17 of the "A" leg 11 and the spring plate 12 correspond to the gaps 18 of the base 14, however, the clearance between the respective plug-in elements 17 and the gaps 18 will cause relative movement between the respective components. Especially, the spring plate 12 is more likely to move during operation. In addition, since it has no any positioning protection, in production test, the I-shaped plug-in elements 17 are often damaged and broken by the existing testing device (the miroswitch is not strong enough in structural strength).

The present invention has arisen to mitigate and/or obviate the afore-described disadvantages.

SUMMARY OF THE INVENTION

The primary object of the present invention is to provide a microswitch connector having stabilized and compact structure. A support of microswitch connector is formed with stepped holes for reception of an "A" leg and a spring plate. The "A" leg and the spring plate are provided with protruding V-shaped foldable members corresponding to receiving gaps on the base. In each of the receiving gaps is provided an abutting piece, the base is further formed with plural positioning cavities corresponding to the feet of the casing. At an end of the "A" leg is provided a projecting conductive point. By assembling the above-mentioned components together, the respective components of the miroswitch connector can be positioned firmly relative to each other, and so as to overcome the problem of relative movement.

The second object of the present invention is to provide a compact microswitch connector that can be prevented from being damaged by testing device during production test. At a folding portion inside the stepped feet of the "A" leg and the spring plate, and that of the casing are formed demolding portion for enabling the foldable members to be easily and accurately folded after the microswitch connector is assembled, so that the surface of the unitary assembly of the microswitch connector will be flat and smooth so as to prevent itself from being hurt by over great stress from the testing device.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
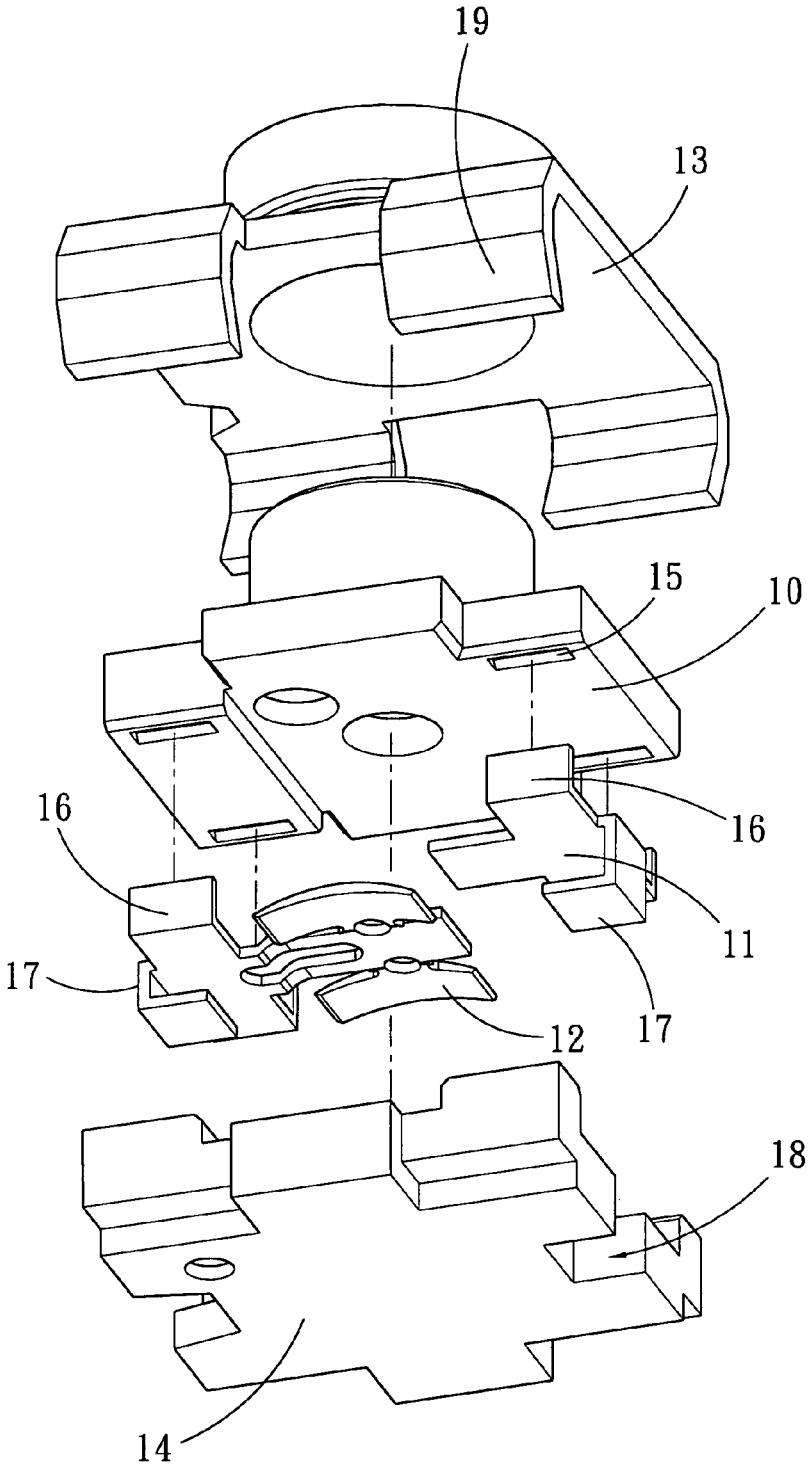
FIG. 1 PRIOR ART
FIG. 1 is an exploded view of a traditional microswitch connector.
Figure 2:
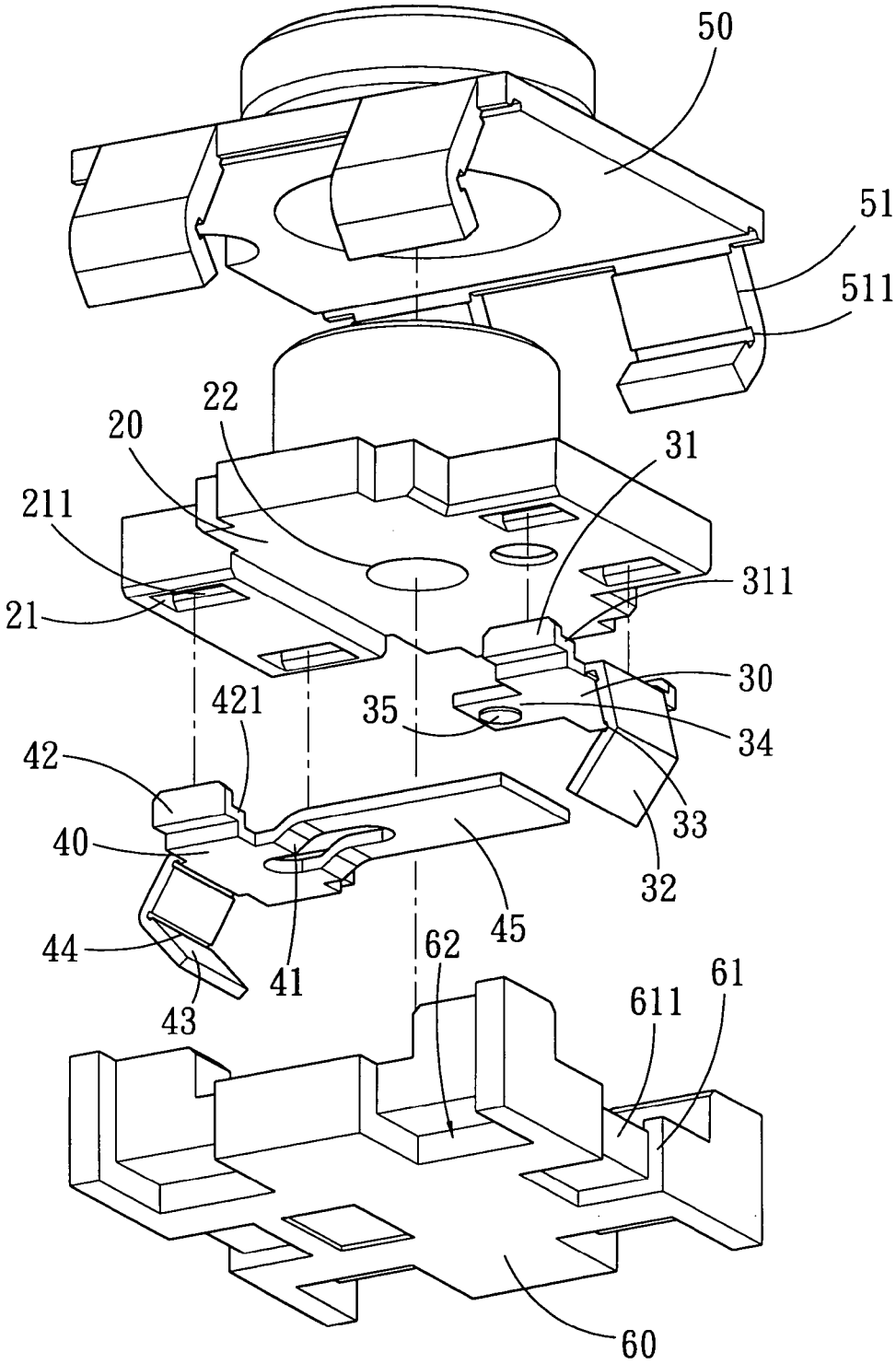
FIG. 2 is an exploded view of a microswitch connector in accordance with the present invention.
Figure 3:
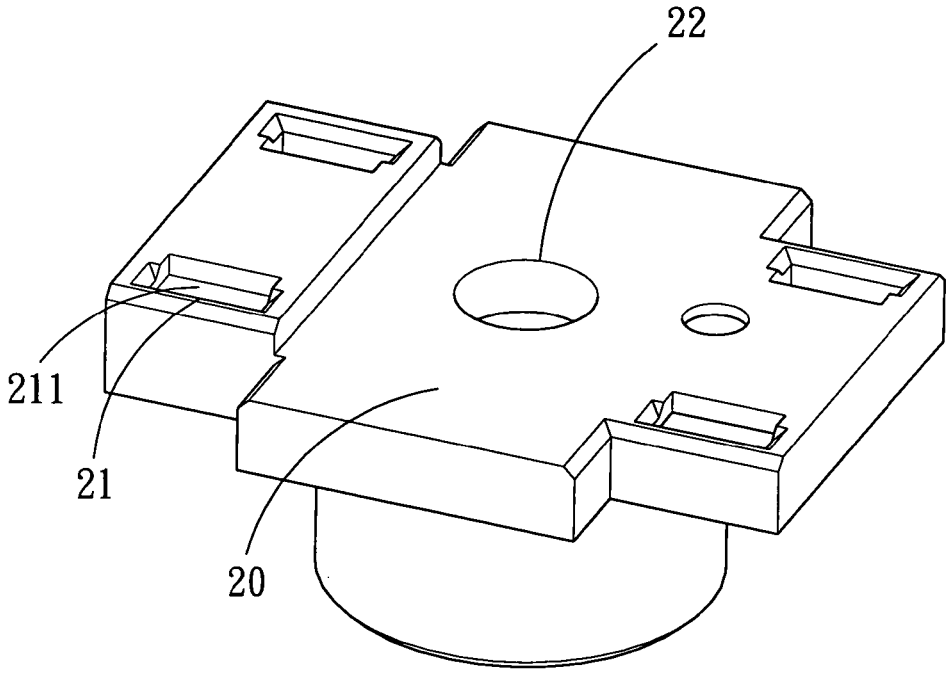
FIG. 3 is an assembly view of a support of the microswitch connector in accordance with the present invention.
Figure 4:
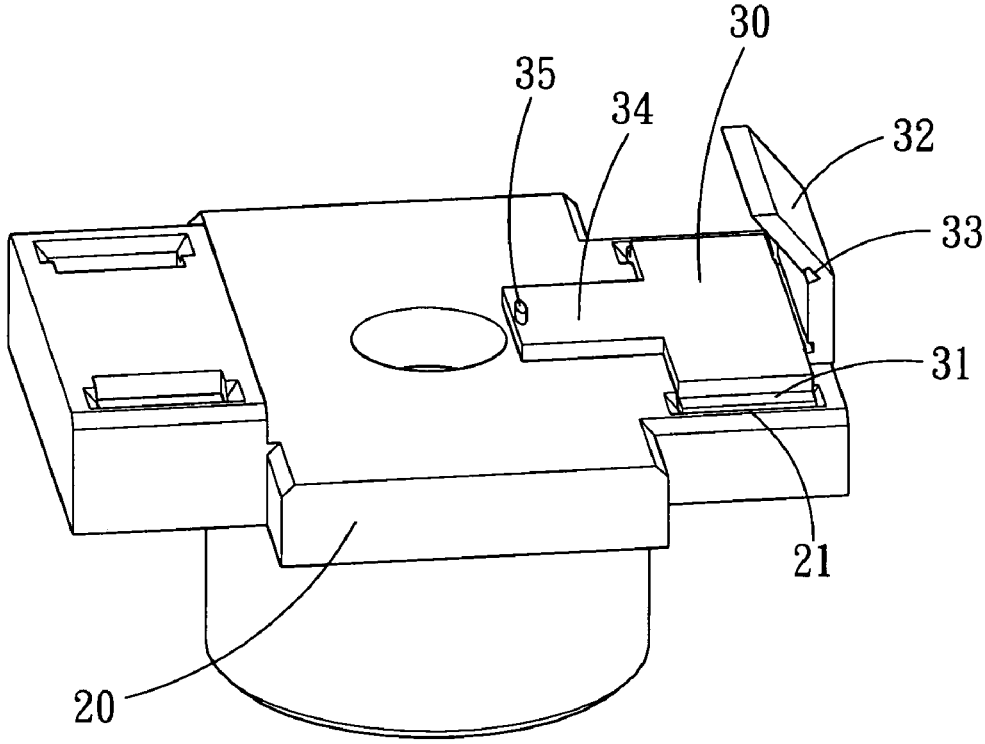
FIG. 4 is an assembly view of a "A" leg of the microswitch connector in accordance with the present invention.
Figure 5:
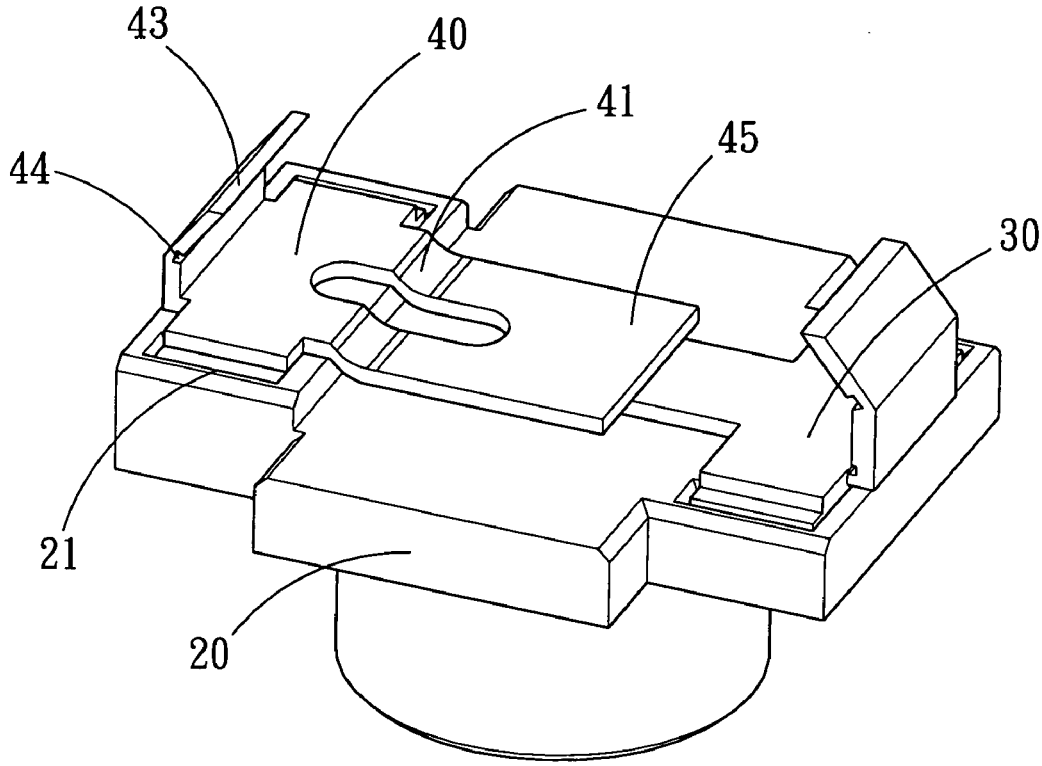
FIG. 5 is an assembly view of a spring plate of the microswitch connector in accordance with the present invention.
Figure 6:
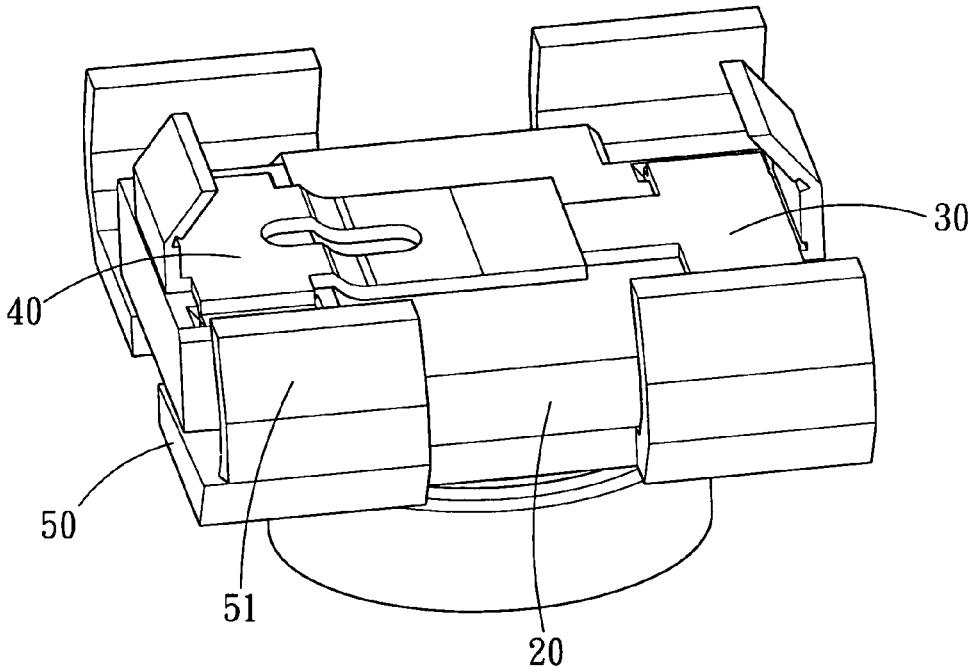
FIG. 6 is an assembly view of a casing of the microswitch connector in accordance with the present invention.
Figure 7:
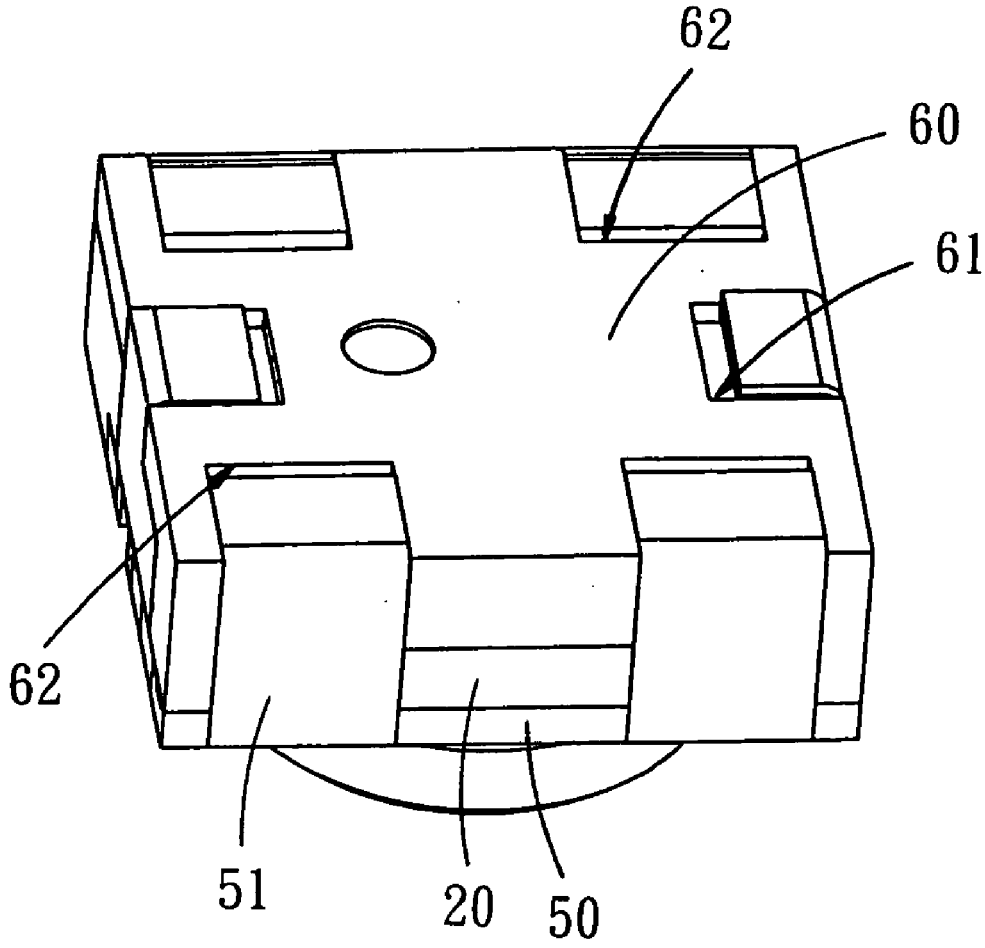
FIG. 7 is an assembly view of the microswitch connector in accordance with the present invention.

Referring to FIG. 2, a microswitch connector in accordance with a preferred embodiment of the present invention generally comprises a support 20, a "A" leg 30, a spring plate 40, a casing 50 and a base 60.

The support 20 having a central hole 22 is formed at two opposite sides with four stepped holes 21 in each of which is provided a stepped block 211.

The "A" leg 30 is a conductive element, at a first end of which are formed two stepped feet 31 which are to be assembled in the stepped holes 21 of the support 20 in such a manner that the shoulder 311 of each of the stepped feet 31 abuts against the stepped blocks 211 of the support 20. At a side opposite to the first end of the "A" leg 30 is provided a protruding V-shaped foldable member 32, at a folding portion inside the V-shaped foldable member 32 is formed a demolding portion 33. The "A" leg 30 is further provided with a sensing plate 34 corresponding to the central hole 22 of the support 20, and at and end of the sensing plate 34 is provided a projecting column-shaped conductive point 35.

The spring plate 40 is a conductive member having a compression spring 41 formed at a center thereof, at a first end of which are provided two stepped feet 42 which are to be assembled in another group of stepped holes 21 on the support 20 in a manner that the shoulder 421 of each of the stepped feet 42 abuts against the stepped blocks 211 of the support 20. At a side of the spring plate 40 opposite to the stepped feet 42 are provided a protruding V-shaped foldable member 43, at a folding portion inside the V-shaped foldable member 43 is formed a demolding portion 44. The spring plate 40 is further provided with a compressive plate 45 corresponding to the central hole 22 of the support 20, which is employed to press on the conductive point 35 of the sensing plate 34.

The casing 50 employed to cover the support 20, at both sides of which are provided four foldable legs 51, at a folding portion inside each of the foldable legs 51 is formed a demolding portion 511.

The base 60 is employed to position the "A" leg 30 and the spring plate 40 by cooperating with the support 20. At both opposite sides of the base 60 are formed plural receiving gaps 61 in each of which is provided an abutting piece 611. The receiving gaps 61 are served to receive the foldable member 43 of the spring plate 40 and the foldable member 32 of the "A" leg 30 in such a manner that the abutting pieces 611 abut against the inner side of the foldable members 32 and 43. At both opposite sides of the base 60 are further formed four positioning cavities 62, so that the respective foldable feet 51 of the casing 50 are folded and locked in the positioning cavities 62.

Referring further to FIGS. 3–7, the support 20 acts as a base when assembling the microswitch connector.

The two stepped feet 31 of the "A" leg 30 are firstly inserted in the stepped holes 21 of the support 20 in such a manner that the shoulder 31 of each of the stepped feet 31 abuts against the stepped blocks 21 of the support 20. Then, the spring plate 40 is a conductive member having a compression spring 41 formed at a center thereof and having the two stepped feet 42 formed at the first end and employed to be assembled in another group of stepped holes 21 on the support 20 in a manner that the shoulder 421 of each of the stepped feet 42 abuts against the stepped blocks 211 of the support 20. At this moment, the stepped blocks 211 of the stepped holes 21 of the support 20 are able to position the shoulders 311, 421 of the stepped feet 31 and 42, respectively.

In addition, the receiving gaps 61 of the base 60 are provided for receiving the foldable members 43 of the spring plate 40 and the foldable members 32 of the "A" leg 30 in such a manner that the abutting pieces 611 abut against the inner surface of the foldable members 32 and 43, so as to improve the stability of the structure. At both opposite sides of the base 60 are further formed the four positioning cavities 62 provided for locking the respective foldable legs 51 of the casing 50. Thus, the support 20, the "A" leg 30, the spring plate 40, the casing 50 and the base 60 are substantially superimposed over one another, and no component will be protruded out of the surface of the unitary assembly after being assembled together (the flat surface of the unitary assembly of the microswitch connector prevents itself from being hurt by over great stress from the testing device), and the respective components are firmly positioned relative to each other. After being soldered on a circuit board, the respective feet of the microswitch connector will be flush with the respective surfaces of the unitary assembly of the microswitch connector and the circuit board, so that the production quality is ensured.

On the other hand, the foldable member 32 of the "A" leg 30 is formed at the inside folding portion with a demolding portion 33, and so is the spring plate 40 which is formed with a demolding portion 44, and the respective foldable legs 51 are also formed with a demolding portion 511 at the inner folding portion. Thus, the respective components of the present invention can be easily folded and positioned, and the folding angle will be accurate.

While we have shown and described various embodiments in accordance with the present invention, it should be clear to those skilled in the art that further embodiments may be made without departing from the scope of the present invention.

What is claimed is:

1. A microswitch connector comprising:

a support having a central hole and formed at two opposite sides with a plurality of stepped holes in which are provided stepped blocks;

an "A" leg being a conductive element, at a first end of which is formed a plurality of stepped feet employed to be assembled in the plurality of stepped holes of the support in such a manner that a shoulder of each of the stepped feet abuts against the stepped blocks of said support, at a side of said "A" leg opposite to the end of provided a foldable member, said "A" leg further provided with a sensing plate corresponding to a central hole of said support;

a spring plate being a conductive member and having a compression spring formed at a center thereof, at a first end of said spring provided plural stepped feet employed to be assembled in another group of stepped holes on said support in a manner that a shoulder of each of the stepped feet abuts against the stepped blocks of said support, at a side of said spring plate opposite to the stepped feet provided a foldable member, the spring plate further provided with a compressive plate corresponding to the central hole of said support, the compression plate employed to be placed on the sensing plate;

a casing covered on said support and provided with a plurality of foldable legs;

a base employed to position said "A" leg and said spring plate by cooperating with said support, at both opposite sides of said base formed with plural receiving gaps in each of which provided an abutting piece, the receiving gaps served to receive the foldable member of said spring plate and the foldable member of said "A" leg in such a manner that the abutting piece abuts against an inner surface of the foldable member of said spring plate and that of said "A" leg, said base further formed with a plurality of positioning cavities provided for locking the respective foldable legs of said casing.

2. The microswitch connector as claimed in claim 1, wherein a demolding portion is formed at a folding portion inside the foldable member of said "A" leg, which enables the foldable member of said "A" leg to be folded at an accurate angle.

3. The microswitch connector as claimed in claim 1, wherein a demolding portion is formed at a folding portion inside the foldable member of said spring plate for enabling the foldable member of said spring plate to be folded at an accurate angle.

4. The microswitch connector as claimed in claim 1, wherein a demolding portion is formed at a folding portion inside each of the foldable feet of said casing.

5. The microswitch connector as claimed in claim 1, wherein a conductive point is provided at an end of the sensing plate of said "A" leg.

6. The microswitch connector as claimed in claim 5, wherein the conductive point at the end of the sensing plate of said "A" leg is projecting and column-shaped.

7. The microswitch connector as claimed in claim 1, wherein the foldable member of said "A" leg is protruding and V-shaped.

8. The microswitch connector as claimed in claim 7, wherein a demolding portion is formed at a folding portion inside the foldable member of said "A" leg, which enables the foldable member of said "A" leg to be folded at an accurate angle.

9. The microswitch connector as claimed in claim 1, wherein the foldable member of said spring plate is protruding and V-shaped.

10. The microswitch connector as claimed in claim 9, wherein a demolding portion is formed at a folding portion inside the foldable member of said spring plate for enabling the foldable member of said spring plate to be folded at an accurate angle.

* * * * *